US007395581B2

(12) United States Patent
Hösel et al.

(10) Patent No.: US 7,395,581 B2
(45) Date of Patent: Jul. 8, 2008

(54) APPARATUS AT A SPINNING ROOM MACHINE FOR DRAWING A CLOTHING ONTO A ROLLER

(75) Inventors: Fritz Hösel, Mönchengladbach (DE); Armin Leder, Mönchengladbach (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 539 days.

(21) Appl. No.: 11/044,296

(22) Filed: Jan. 28, 2005

(65) Prior Publication Data

US 2005/0160560 A1 Jul. 28, 2005

(30) Foreign Application Priority Data

Jan. 28, 2004 (DE) ..... 10 2004 004 433

(51) Int. Cl.
*D01G 15/92* (2006.01)

(52) U.S. Cl. ..... 19/114
(58) Field of Classification Search ..... 19/98, 19/105, 114

See application file for complete search history.

(56) References Cited

U.S. PATENT DOCUMENTS 4,951,359 A * 8/1990 Leifeld et al. ..... 19/98

FOREIGN PATENT DOCUMENTS

| | | | |
|---|---|---|---|
| DE | 240 569 | A1 | 11/1986 |
| DE | 43 19 631 | C2 | 12/1994 |
| GB | 630280 | | 10/1949 |
| GB | 818651 | | 8/1959 |
| GB | 832269 | | 4/1960 |
| GB | 2204152 | A | 11/1988 |
| WO | WO 02/46505 | A1 | 6/2002 |

* cited by examiner

*Primary Examiner*—Shaun R. Hurley
(74) *Attorney, Agent, or Firm*—Venable LLP; Robert Kinberg; Steven J. Schwarz

(57) ABSTRACT

In an apparatus at a spinning room machine, especially a carding machine, cleaner or the like, for drawing a clothing onto a roller using a roller drive unit, which apparatus comprises a drive motor arranged to be in drive connection with the roller drive unit or with at least one roller of the machine, the drive motor co-operates with a rotary speed adjustment device. In order to allow, by simple means, automatic matching of the actual value of the speed of rotation to a prespecified value of the speed of rotation, the drive motor co-operates with a closed-loop rotary speed control device which is incorporated into the control and regulation device of the spinning room machine.

24 Claims, 5 Drawing Sheets

APPARATUS AT A SPINNING ROOM MACHINE FOR DRAWING A CLOTHING ONTO A ROLLER

CROSS REFERENCE TO RELATED APPLICATION

This application claims priority from German Patent Application No. 10 2004 004 433.3 dated 28 Jan. 2004, the entire disclosure of which is incorporated herein by reference.

BACKGROUND OF THE INVENTION

The invention relates to an apparatus at a spinning room machine, especially a card, carding machine, cleaner or the like, for drawing a clothing onto a roller.

In the area of the textile industry, especially in the case of cards and carding machines, there are a large number of rollers which have to be provided with clothings. Usually, those clothings are initially drawn on when the machines are being manufactured, that is to say when the rollers are in the uninstalled state. However, the clothings are wearing parts, which routinely have to be replaced after a certain period of operation. The replacement is usually carried out at the user's premises and with the rollers in the installed state. Very complicated equipment is required for the purpose. Amongst other things, the rollers have to be driven in a very specific manner for the clothing process, for which a separate, rotary speed-controlled motor having a complicated holding means is used. In addition, the fact that the apparatus has to be mobile means that often considerable shortcomings with respect to, inter alia, convenience, have to be accepted.

In a known apparatus, there is provided a drive system for cards provided with carding flats, or carding machines, having at least one speed-of-rotation-controlled three-phase-current motor, with which there is associated an open-loop speed-of-rotation control device. Each three-phase-current motor can be controlled using a frequency converter by way of a D/A transducer. In the procedure for drawing on the all-steel clothing, one of the three-phase-current motors, the speed of rotation of which is subject to open-loop control, is arranged to be brought into drive connection mechanically with the licker-in, cylinder or doffer. Feedback of the actual value of the speed of rotation is not provided. In that apparatus, it is disadvantageous that a prespecified speed of rotation cannot be kept constant in the event of changes in the load. There is no automatic matching of the actual value of the speed of rotation to the prespecified value of the speed of rotation. In addition, the known apparatus is complicated.

It is an aim of the invention to provide an apparatus of the kind described at the beginning that avoids the mentioned disadvantages and, especially, that allows automatic matching of the actual value of the speed of rotation to a prespecified value of the speed of rotation and which is simple in terms of equipment.

The invention provides a spinning room machine having an arrangement for applying clothing to a roller, having:

a roller requiring clothing;

a drive motor for a working roller of the machine; and a control and regulation system for at least a part of the machine, including a closed-loop control device; wherein said drive motor is in driving connection with said roller requiring clothing and the closed-loop control device is arranged to control said drive motor for drawing clothing onto said roller requiring clothing.

In accordance with the invention, a control and regulation device of the spinning room machine is used for closed-loop control of the actual value of the speed of rotation. By that means, automatic matching of the actual speed of rotation to a prespecified actual speed of rotation is advantageously brought about by way of the internal closed-loop control device of the machine. At the same time, the actual speed of rotation is kept constant at the prespecified actual speed of rotation by the closed-loop control device even in the event of changes or variations in the load to which the roller drive unit and/or the roller is subjected.

The closed-loop rotary speed control device may be incorporated into the electronic machine control and regulation device. The closed-loop rotary speed control device may be incorporated into the electronic motor control and regulation devices. For operation of the closed-loop rotary speed control device, the operating device of the spinning room machine may be used. The display device of the spinning room machine may be used to display information about the drawing-on process. For drawing-on, an optimum drive motor torque may be generated. The optimum torque can if desired be modifiable during drawing-on. The optimum torque may if desired be arranged to be constant during drawing-on. By way of the display device, the operator may receive instructions, observations, information and the like before, during and after drawing-on. For driving a roller to be clothed, there may be used a drive motor of the carding machine which is provided for driving another roller during production. The other roller may be a roller of the carding machine. The other roller may be a roller of a device located upstream, for example of the card feeder. The other roller may be a roller of a device located downstream, for example of the can coiler or the carding machine drawing mechanism. The doffer motor may be usable for driving the cylinder during the clothing process. The intake motor may be usable for driving the cylinder during the clothing process. A motor of a delivery device may be usable for driving the cylinder during the clothing process. A doffer motor may be so arranged that it can drive the doffer during the clothing process. The cylinder motor may be so arranged that it can drive the cylinder during the clothing process. The requisite functions for drawing-on of the clothings, especially the drive for the roller being clothed, may expediently be capable of being accomplished by means of the control of the machine, for example, cleaning or carding machine.

During the drawing-on process, the drive for the roller being clothed may expediently generate a torque which is dependent on position and/or a speed of rotation which is dependent on position. In the control and regulation apparatus there may be provided a specific program for the clothing process which is started up when required. The program for the clothing process may be arranged to be capable of generating particular torques and/or speeds of rotation necessary for an optimum clothing result. The arrangement may be such that generation is accomplished irrespective of the drawing-on position in question. In the clothing process, for the drive motor in question a set of parameters optimising the function of the motor may be loadable into the corresponding drive control.

A braking device may be provided which comprises an adjustment device for adjusting the braking action. The braking device may comprise a control and/or regulation device by means of which the braking action can be automatically matched to the pretensioning for winding-on. The roller drive unit may be incorporated into the open-loop and/or closed-loop control circuit of the control and/or regulation unit and the roller drive unit can be subjected to open-loop and/or closed-loop control for automatic matching to the predetermined pretensioning for winding-on.

The invention also provides an apparatus at a spinning room machine, especially a card, carding machine, cleaner or the like, for drawing a clothing onto a roller using a roller drive unit, which apparatus comprises a drive motor arranged to be in drive connection with the roller drive unit or with at least one roller of the machine and in which apparatus the drive motor co-operates with a speed-of-rotation adjustment device, characterised in that the drive motor co-operates with a closed-loop speed-of-rotation control device which is incorporated into the control and regulation system of the spinning room machine.

Furthermore, the invention provides a method of clothing a roller of a textile machine, comprising drawing clothing onto the roller to be clothed by rotating the roller to be clothed, and controlling the rotary speed of the roller to be clothed by means of a closed-loop control device that in use of the textile machine is operable to control the rotary speed of a fibre-processing roller.

BRIEF DESCRIPTION OF THE DRAWINGS

With reference to FIG. 1, a carding machine K, for example a carding machine of the kind known as TC 03 made by Trutzschler GmbH & Co. KG of Monchengladbach, Germany, has a feed roller 1, feed table 2, lickers—in 3*a*, 3*b*, 3*c*, cylinder 4, doffer 5, stripper roller 6, nip rollers 7, 8, web-guiding element 10, draw-off rollers 11, 12, revolving card top 13 having card-top-deflecting rollers 13*a*, 13*b* and card top bars 14, can 15 and can coiler 16. Curved arrows denote the directions of rotation of the rollers. Reference letter M denotes the centre (axis) of the cylinder 4. Reference numeral 4*a* denotes the clothing and reference numeral 4*b* denotes the direction of rotation of the cylinder 4. Reference letter C denotes the direction of rotation of the revolving card top 13 at the carding location and reference letter B denotes the direction in which the card top bars 14 are moved on the reverse side. Reference numeral 17 denotes a clearer roller for the stripper roller 6 and reference numeral 18 denotes a card feeder.

FIG. 2*a* shows, by way of example, a drive arrangement. Various drive motors and transmission elements together form the drive solution for the TC 03 carding machine. The cylinder 4 and lickers—in 3 are driven by associated three-phase-current motors. Special, maintenance-free belts ensure a long service life. A separate drive subject to closed-loop control is provided for removal of the fibre web in the case of the TC 03. Consequently, it is possible for the ideal degree of drafting to be selected for any speed. Even during starting-up and slowing-down, the degree of drafting that is correct for the speed at any given moment is always set by the control. This means that the slivers in the can are more uniform, from the first metre to the last. The motors for the draw-in roller 1, doffer 5 and web removal are associated servo drives. There are no high-maintenance gear mechanisms, for example in the doffer drive. The motors do not have brushes and consequently are completely maintenance-free. They are distinguished by very good dynamic properties and, consequently, by a speed-of-rotation characteristic that is independent of the load. As a result, the short-wave evenness (Uster value) of the carded slivers is improved. A servo drive is additionally used in the case of optimal separate arrangement of the can coiler and can changer (see FIG. 2*b*).

FIG. 2*c* shows an electric drive motor 21 wherein the speed of rotation is subject to closed-loop control, for example an AC servo motor, and FIG. 2*d* shows an electric drive motor 22 wherein the speed of rotation is not subject to closed-loop control, for example a non-controlled AC motor (AC=alternating current).

Figure 1:
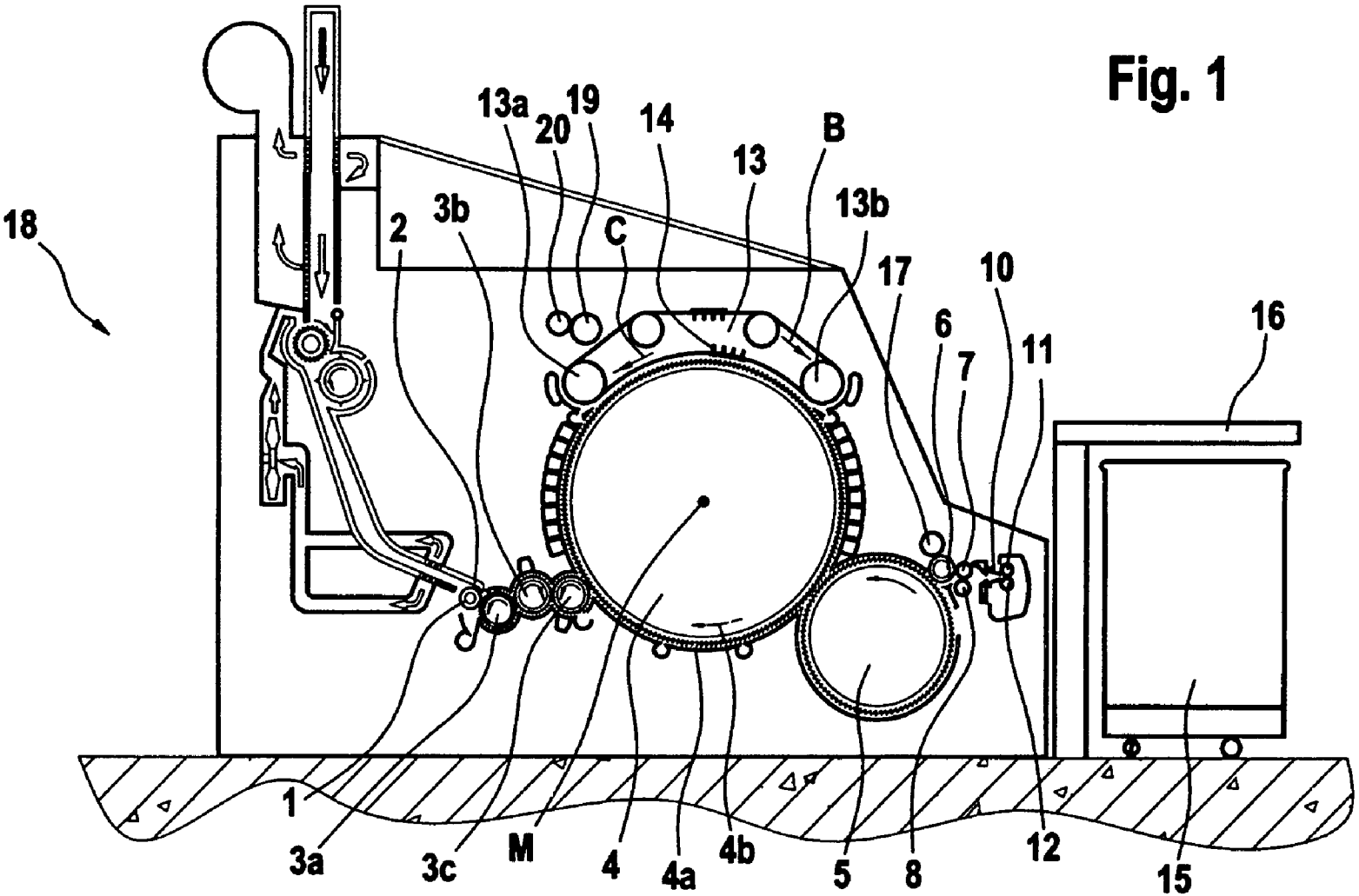
FIG. 1 is a diagrammatic side view of a carding machine with an apparatus according to the invention.
Figure 2A:
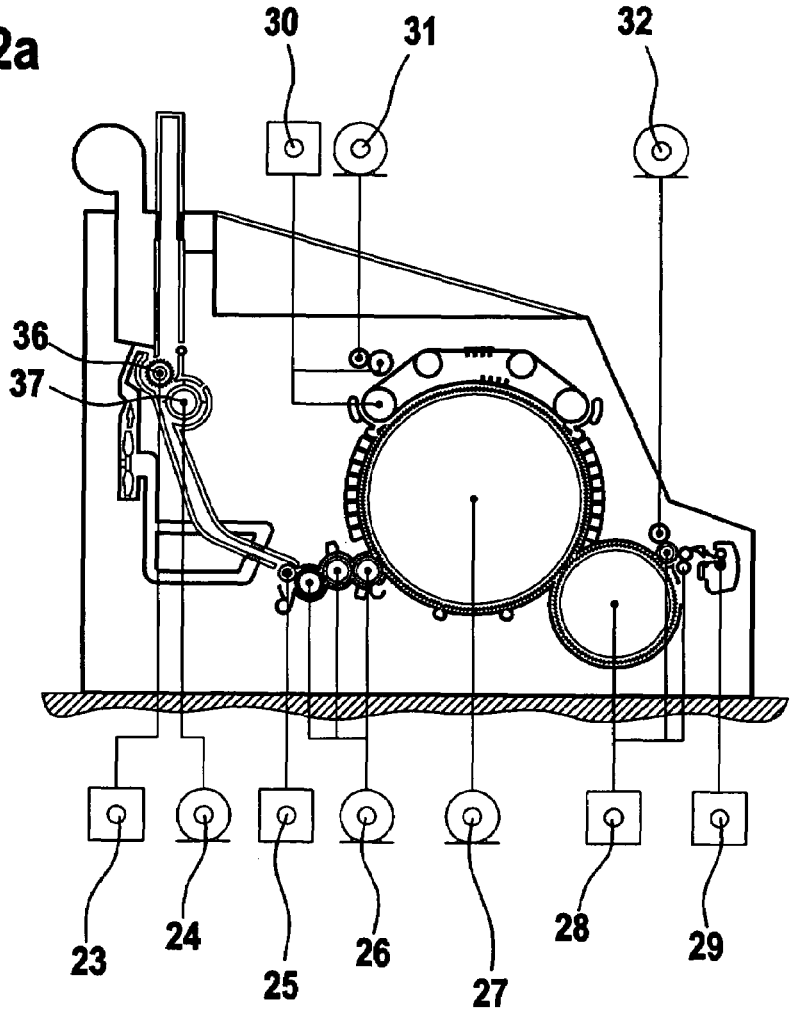
FIG. 2*a* is a schematic view of an upstream part of the machine according to FIG. 1, showing a drive arrangement having drive motors for the carding machine and the card feeder.
Figure 2B:
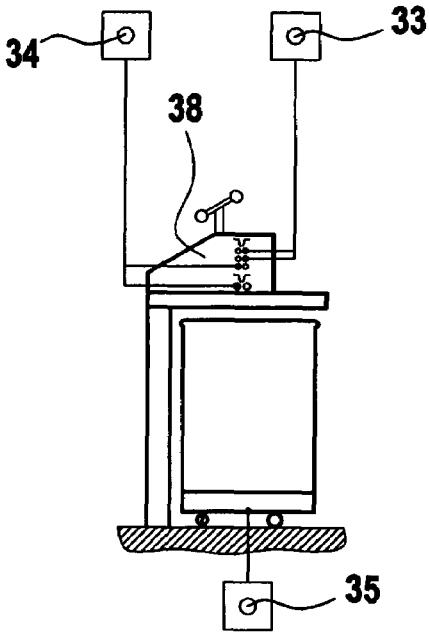
FIG. 2*b* is a schematic view of a downstream part of the machine in FIG. 1, showing a drive arrangement having drive motors for the can coiler according to FIG. 1 and a carding machine drawing mechanism.
Figure 2C:
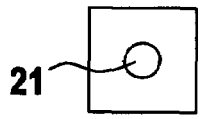
FIG. 2*c* shows a drive motor, the speed of rotation of which is subject to closed-loop control.
Figure 2D:
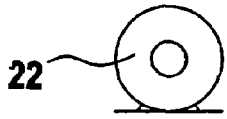
FIG. 2*d* shows an alternating-current drive motor, the speed of rotation of which is not subject to closed-loop control (AC drive)

In accordance with FIG. 2*a*, the following rollers are driven by a motor 21 wherein the speed of rotation is subject to closed-loop control: the intake roller 36 of the card feeder 18, by motor 23; the feed roller 1 of the carding machine K, by motor 25; the doffer 5, stripper roller 6 and nip rollers 7, 8, by motor 28; draw-off rollers 11, 12, by motor 29; rear card-top-deflecting roller 13*a* and clearer roller 19, by motor 30; intake and middle roller pairs of the carding machine drawing mechanism 38, by motor 33; delivery roller pair of the carding machine drawing mechanism 38, by motor 34; and can turntable, by motor 35. The following rollers are driven by a motor wherein the speed of rotation is not subject to closed-loop control: opener roller 37 of the card feeder 18, by motor 24; lickers—in 3*a*, 3*b*, 3*c*, by motor 26; cylinder 4, by motor 27; scraper roller 20, by motor 31; and clearer roller 17, by motor 32.

Figure 3:
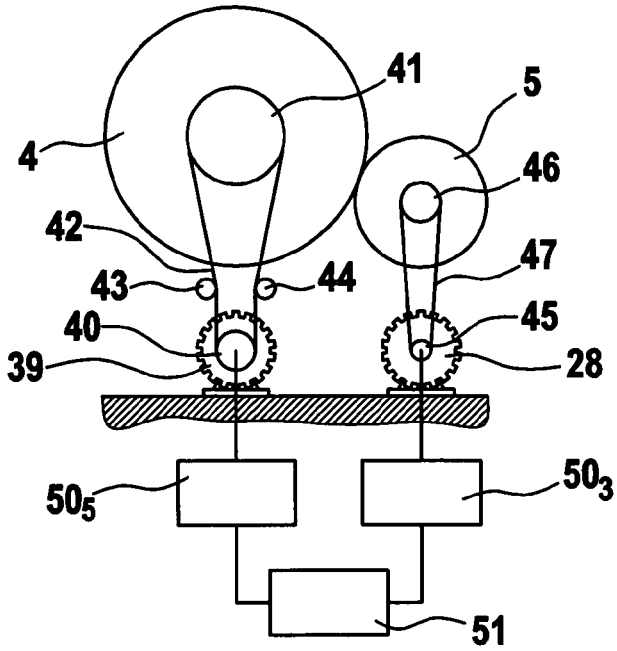
FIG. 3 is a schematic side view of a part of a carding machine, showing a drive motor, the speed of rotation of which is subject to closed-loop control, for the cylinder and one for the doffer, which are used both during production and during clothing of the cylinder and of the doffer.

In accordance with FIG. 3, the cylinder 4 is driven by a motor 39, the speed of rotation of which is subject to closed-loop control, and the doffer 5 is driven by the motor 28, the speed of rotation of which is subject to closed-loop control. On the shaft of the motor 39 there is arranged a belt wheel 40 and on the shaft of the cylinder 4 there is arranged a belt wheel 41, around which belt wheels there is looped an endless belt 42 as drive means. The outside of the belt 42 is in engagement with a guide roller 43 and a tensioning roller 44. On the shaft of the motor 28 there is arranged a belt wheel 45 and on the shaft of the doffer 5 there is arranged a belt wheel 46, around which belt wheels there is looped an endless belt 47 as drive means. The controlled motor 39, by way of an electronic motor control and regulation device $50_5$, and the controlled motor 28, by way of an electronic motor control and regulation device $50_3$, are in electronic communication (see FIG. 5) with an electronic machine control and regulation device 51.

Figure 4A:
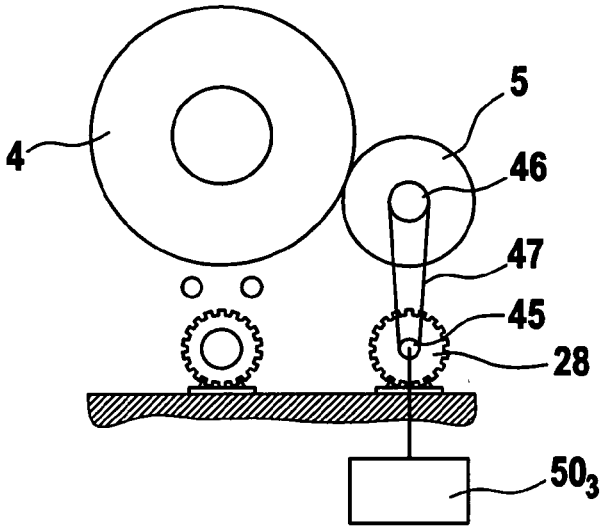
FIG. 4*a* is a schematic side view of a part of a carding machine showing a drive motor, the speed of rotation of which is subject to closed-loop control, for the doffer whilst the doffer is in production.
Figure 4B:
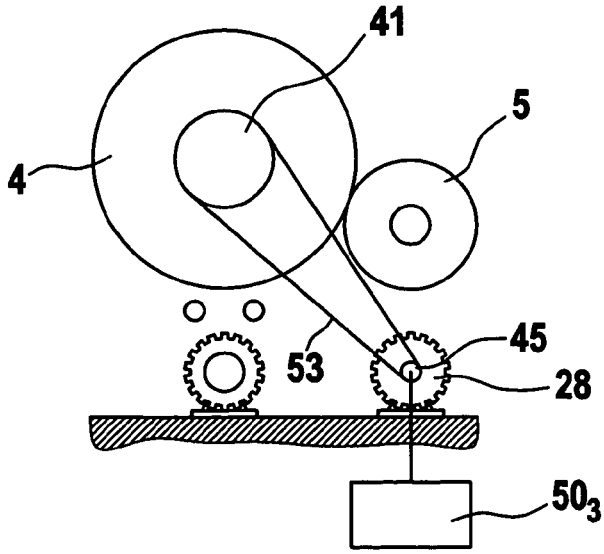
FIG. 4*b* shows the rotary speed-controlled drive motor for the doffer according to FIG. 4*a* whilst the cylinder is being clothed.

In accordance with FIGS. 4*a*, 4*b*, the motor 28, whose speed of rotation is subject to closed-loop control, is associated with the doffer 5. When the carding machine is in production, the motor 28 drives the doffer 5 by way of the belt 47 (see FIG. 4*a*). The belt 47 loops around the belt wheels 45 and 46. When the cylinder 4 is being clothed, the motor 28 drives the cylinder 4 by way of another belt 53 (see FIG. 4*b*). The belt 53 loops around the belt wheels 45 and 41. The belt wheel 41 forms a, or forms a part of a, roller drive unit for the cylinder 4.

By that means, a motor already present in the machine and provided with a closed-loop rotary speed control is used for driving the rollers during the clothing process at the customer's premises. That motor can be, in accordance with FIG. 3, a motor (39 or 28) which is in any case present for operation of the roller 4 or 5 in question during production. However, it is also possible, in accordance with FIGS. 4*a*, 4*b*, for the doffer motor 28, which is, as standard, provided with a high-precision closed-loop speed-of-rotation control, to be used for clothing the cylinder 4. All that is required is for the drive belts 42 and 43 between the doffer motor 28 and doffer 5 and between the cylinder motor 39 and cylinder 4 to be removed and for a belt 53 or similar to be attached between the doffer motor 28 and cylinder 4 (FIG. 4*b*). The mechanical design of the machine is such that a drive transfer of that kind is possible and appropriate belt wheels of the correct size and type are already present. By that means it is possible very simply, rapidly and using only minimum outlay to achieve the drive for clothing the rollers.

Figure 5:
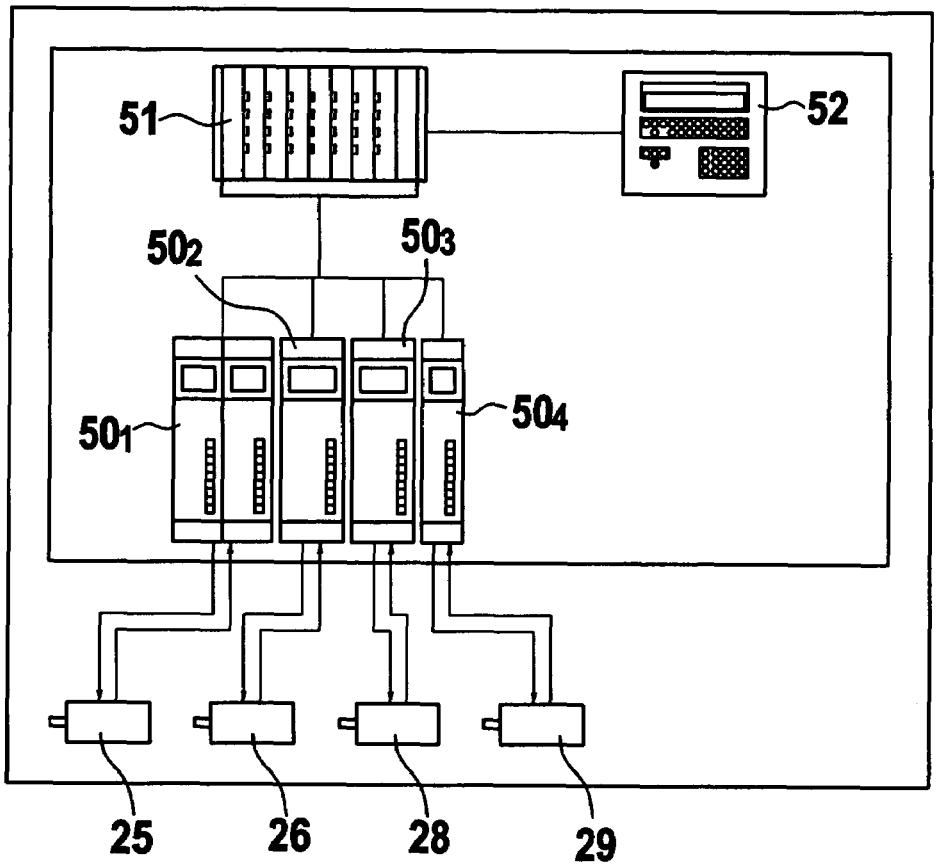
FIG. 5 is a generalised circuit diagram with an electronic machine control and regulation device, electronic motor control and regulation devices and operating motors for the machine.

In accordance with FIG. 5, a plurality of motor control and regulation devices $50_1$, $50_2$, $50_3$, $50_4$, for example servo axis controls, are provided. A drive motor, for example a motor 25, 26, 28, 29, is connected to each servo axis control $50_1$, $50_2$, $50_3$, $50_4$, respectively. The servo axis controls $50_1$, $50_2$, $50_3$, $50_4$ are connected to the electronic machine control and regulation device 51, for example of the kind known as TMS 2 made by Trtitzschler GmbH & Co. KG.

Reference numeral 52 denotes an operating and display unit, which is connected to the machine control and regulation device 51.

Figure 6:
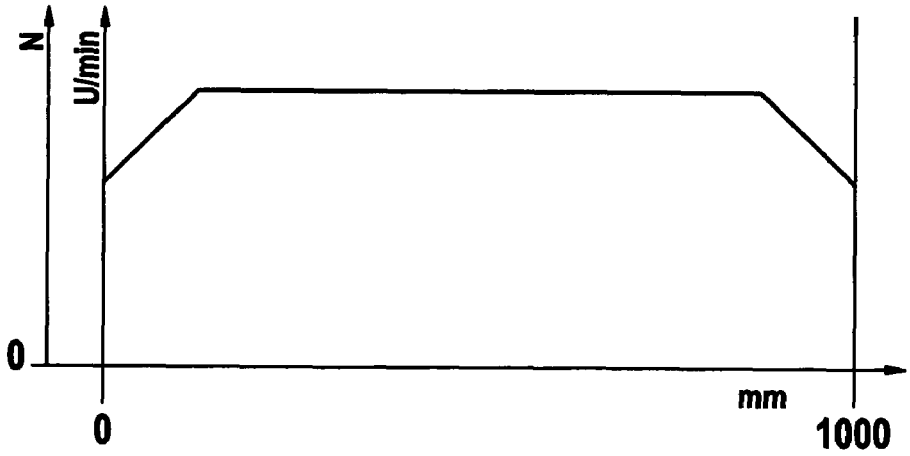
FIG. 6 is a graph showing the dependence of the speed of rotation and torque of the drive motor for clothing on the drawing-on position of the clothing across the width of the roller.

In accordance with FIG. 6, the dependence of the torque (N) and speed of rotation in revolutions per minute (u/mm.) of the drive motor, for example motor 28, during clothing of a roller, for example the cylinder 4, on the drawing-on position of the clothing wire 56 (see FIG. 7), seen across the width a of the roller, is shown.

Figure 7:
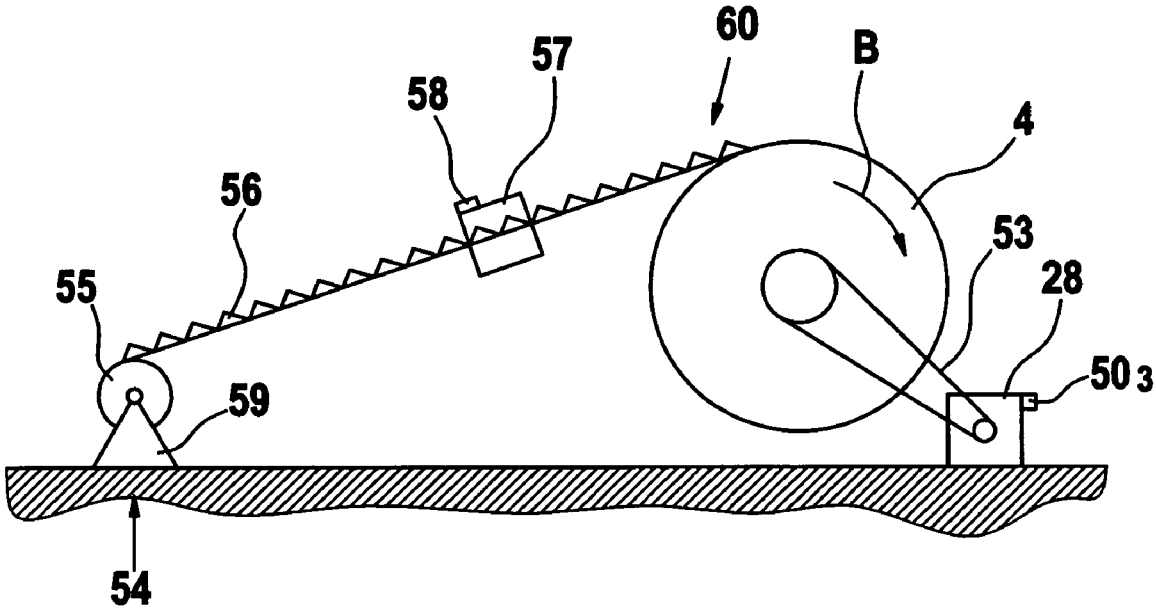
FIG. 7 is a diagrammatic side view of a winding-on and winding-off apparatus.

The drawing-on apparatus shown in FIG. 7 basically comprises a holding station 54 for a supply coil 55 on which a card clothing 56 in the form of sawtooth wire is wound flat, a braking device 57 and a roller 4. The roller 4 is driven in the clockwise direction B by means of a motor 28 and a transmission device 53. The motor 28 has a control and regulation device $50_3$, by means of which the speed of the roller 4 and also the direction of rotation can be controlled. The braking device 57 comprises a control and regulation device 58, which ensures a particular braking action. The control and regulation device $50_3$ and the control and regulation device 58 are in operative connection with one another. In a further embodiment, they can also be used in the form of a unit for controlling both the braking device 57 and also the motor 28.

The carding clothing 56 in the form of sawtooth wire is wound off from the supply coil 55 arranged on a mounting block 59 and is then passed through the braking device 57 and wound onto the outer periphery of the roller 4. After the winding-on process, the carding clothing 56 then extends around the outer periphery of the roller 4 on a helical course.

The braking device 57, in co-operation with the roller 4 and in that case, especially, the roller drive, the motor 28, is intended to exert pre-tensioning in the region 60 of the carding clothing 56. That pre-tensioning ensures that the carding clothing 56 is uniformly and lastingly wound on or drawn on.

The closed-loop speed-of-rotation control device is an integral part of the control and regulation system 51; $50_1$ to $50_5$. For the invention, use is made especially of the closed-loop speed-of-rotation control function of the motor control and regulation devices $50_1$ to $50_5$.

Commercially available closed-loop speed-of-rotation control devices can be used. Closed-loop servo control devices specifically matched to the machine can also be used. The closed-loop servo control devices can be controlled directly by digital signals by way of a bus system, for example CANbus. Feedback of the actual value of the speed of rotation is used in the process.

Although the foregoing invention has been described in detail by way of illustration and example for purposes of understanding, it will be obvious that changes and modifications may be practised within the scope of the appended claims.

What is claimed is:

1. A spinning room machine having an arrangement for applying clothing to a roller, having:

a roller requiring clothing;

a drive motor for a working roller of the machine; and a control and regulation system for at least a part of the machine, including a closed-loop control device;

wherein said drive motor is in driving connection with said roller requiring clothing, and the closed-loop control device is arranged to control said drive motor for drawing clothing onto said roller requiring clothing, the closed-loop control device arranged to control said drive motor based on feedback of the actual speed of said roller requiring clothing.

2. A machine according to claim 1, in which said roller requiring clothing and said working roller are one and the same roller.

3. A machine according to claim 1, in which said roller requiring clothing is a second working roller of said machine.

4. A machine according to claim 3, in which a closed-loop control device of a working roller that is downstream of said roller requiring clothing can be used for driving the roller requiring clothing.

5. A machine according to claim 4, in which the roller to be clothed is a cylinder of a carding machine and the working roller is selected from a doffer, rollers of a can-coiling mechanism, and rollers of a card machine drawing mechanism.

6. A machine according to claim 3, in which a closed-loop control device of a working roller that is upstream of said roller requiring clothing can be used for driving the roller requiring clothing.

7. A machine according to claim 4, in which the roller to be clothed is a cylinder and the working roller is selected from rollers of a card feeder.

8. A machine according to claim 1, in which the closed-loop rotary speed control device is arranged to generate an optimum drive motor torque for drawing-on the clothing.

9. A machine according to claim 8, in which the torque is adjustable during drawing-on.

10. A machine according to claim 9, in which a drive motor for the roller being clothed can during clothing generate a torque which is dependent on position.

11. A machine according to claim 9, in which a drive motor for the roller being clothed can during clothing generate a speed of rotation which is dependent on position.

12. A machine according to claim 1, comprising a program for the clothing process, which program is arranged to generate torques and/or rotary speeds selected for producing an optimum clothing result.

13. A machine according to claim 1, in which there is a clothing device which comprises a braking device.

14. A machine according to claim 13, in which the braking device comprises an adjustment device for adjusting the braking action of the braking device.

15. A machine according to claim 13, in which the braking device comprises a control and/or regulation device by means of which the braking action can be automatically matched to a desired pretensioning for wind-on.

16. A machine according to claim 1, in which the roller requiring clothing comprises a roller drive unit and the drive motor is in driving connection with the roller drive unit for driving the roller requiring clothing.

17. An apparatus at a spinning room machine for drawing a clothing onto a roller using a roller drive unit, which apparatus comprises:

a drive motor arranged to be in drive connection with the roller drive unit or with at least one roller of the machine and in which apparatus the drive motor co-operates with a speed-of-rotation adjustment device, wherein the drive motor co-operates with a closed-loop speed-of-rotation control device which is incorporated into the control and regulation system of the spinning room machine, the closed-loop speed-of-rotation control device arranged to control the drive motor based on feedback of the actual speed of the roller drive unit or the at least one roller of the machine.

18. A method of clothing a roller of a textile machine, comprising:

drawing clothing onto the roller to be clothed by rotating the roller to be clothed, and controlling the rotary speed of the roller to be clothed by means of a closed-loop control device based on feedback of the actual speed of the roller to be clothed, wherein during use of the textile machine, the closed-loop control device is operable to control the rotary speed of a fibre-processing roller.

19. A method according to claim 18, in which said fibre-processing roller and said roller to be clothed are the same roller.

20. A method according to claim 19, in which in a carding machine the doffer motor is used for driving the doffer during the clothing process.

21. A method according to claim 19, in which in a carding machine the cylinder motor is used for driving the cylinder during the clothing process.

22. A method according to claim 18, in which said fibre-processing roller is a different roller from said roller to be clothed.

23. A method according to claim 22, in which said fibre-processing roller is upstream of said roller to be clothed.

24. A method according to claim 23, in which said fibre-processing roller is downstream of said roller to be clothed.

* * * * *